US005971056A

United States Patent [19]

Bovens

[11] Patent Number: 5,971,056

[45] Date of Patent: Oct. 26, 1999

[54] DEVICE FOR HARDENING FOUNDRY CORES AND USE THEREOF

[75] Inventor: Wilhelm Bovens, Gähwil, Switzerland

[73] Assignee: Lüger GmbH, Bazenheid, Switzerland

[21] Appl. No.: 08/863,913

[22] Filed: May 27, 1997

[51] Int. Cl.[6] ..... B22C 9/12

[52] U.S. Cl. ..... 164/16; 164/159

[58] Field of Search ..... 164/159, 16, 456

[56] References Cited

U.S. PATENT DOCUMENTS

| | | | |
|---|---|---|---|
| 3,590,902 | 7/1971 | Walker et al. | 164/16 X |
| 4,362,204 | 12/1982 | Moore et al. | 164/16 |
| 4,483,384 | 11/1984 | Michel | 164/16 X |
| 4,540,531 | 9/1985 | Moy | 164/16 X |
| 5,005,630 | 4/1991 | Gähler | 164/159 X |

FOREIGN PATENT DOCUMENTS

| | | | |
|---|---|---|---|
| 2025253 | 12/1971 | Germany | 164/16 |
| 2162137 | 6/1973 | Germany | 164/16 |
| 2413537 | 10/1975 | Germany | 164/16 |
| 2621153 | 11/1977 | Germany | 164/16 |
| 3135510 | 3/1983 | Germany | 164/16 |
| 3340762 | 5/1985 | Germany | 164/159 |
| 667821 | 11/1988 | Switzerland | 164/16 |

*Primary Examiner*—J. Reed Batten, Jr.

*Attorney, Agent, or Firm*—Venable; George H. Spencer; Ashley J. Wells

[57] ABSTRACT

A device for hardening a core mass containing sand contained within a foundry core forming tool includes a mixing device in communication with the foundry core forming tool for introducing a flow of a carrier gas stream enriched by catalyst vapor into the core mass containing sand; a first runnings system including a catalyst receiver tank containing catalyst, a first runnings pipe in communication with the catalyst receiver tank and the mixing device, a pump provided in the first runnings pipe for pumping catalyst from the catalyst receiver tank through the first runnings pipe, valve device provided in the first runnings pipe for dispensing catalyst into the mixing device, and a flow meter provided in the first running pipe between the pump and the valve device; a compressed air source in communication with the mixing device for providing a carrier gas stream comprised of air thereto; and programmed control device for controlling the valve device of the first runnings system and the compressed air source; wherein the valve device provided in the first runnings pipe may be temporarily utilized as a return pipe to the receiver tank by signal from the programmed control device so that pressure equalization in the first runnings system is obtained. The above device is useful for hardening a foundry core within a core forming tool of a core shooter by providing the core forming tool with such a device.

9 Claims, 1 Drawing Sheet

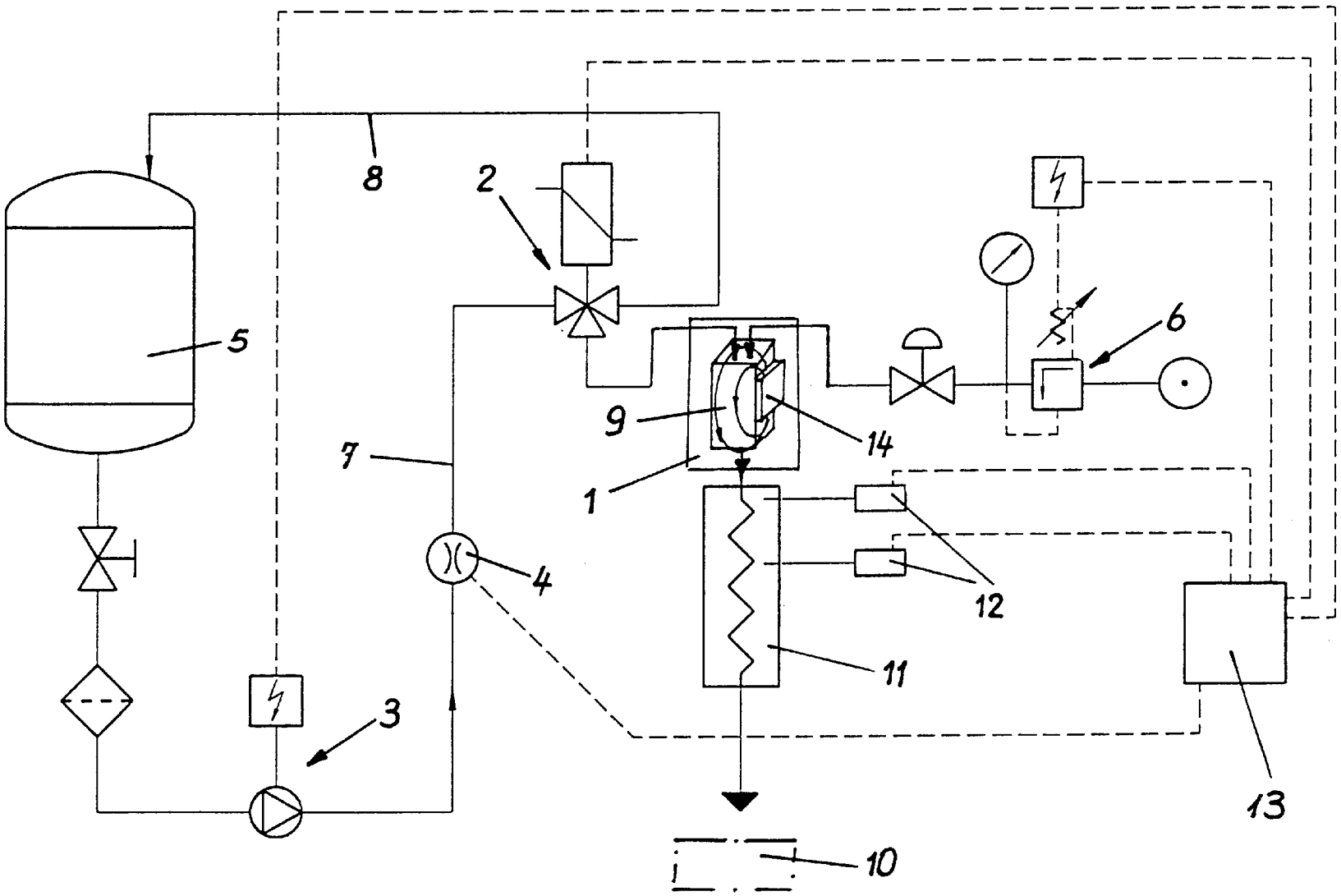
13
6
12
14
11
10
9
1
2
4
8
7
3
5

DEVICE FOR HARDENING FOUNDRY CORES AND USE THEREOF

BACKGROUND OF THE INVENTION

1. Field of the Invention

The present invention relates to a device for hardening a foundry core from a mass containing sand in which the mass for hardening in the core form-tool is exposed to a gas stream enriched by a catalyst and, if necessary, subsequently to a compressed-air stream, with a mixing stage connectable ahead of the core form-tool for generating a catalyst vapor-carrier gas mixture which is in a flow connection with a catalyst receiver tank as well as with a program-controlled compressed-air source, by way of program-controlled valve means, pump means and flow meters.

2. Description of the Related Art

Such devices are well known; they allow for example, the so-called cold box casting process in which two components of an artificial resin system are added to the core sand which subsequently harden together with the sand as soon as an amine, for example an alkyl amine or a methyl formate, is added as a catalyst. In this, one component could, for example, be a polyester resin, a polyether or any artificial resin of liquid consistency with reactive hydroxyl groups; the second component is in every case an organic isocyanate. The two components are thoroughly mixed with the molding sand and then formed. Various attempts have been made to then catalyze the reaction and to render handling and use, in particular of the amines reliable.

Thus it has been well known for quite some time to push a mixture of tertiary alkyl amine and air through the isocyanate resin-sand mixture whereby this amine-air mixture is heated to a temperature of 30–50° C. in order to vaporize all amine droplets.

However, the known processes have the common disadvantage in that the hardening process takes a considerable time. For example, mold release of the core-sand mixture in the form-tool often takes only a fraction of a second on a core shooter; by contrast, subsequent gasification for hardening the core needs to be maintained for several seconds. Naturally, as a result, gasification is enormously costly.

In order to reduce gasification time or hardening time, as a rule, it became customary to add an overdose of amines, with the danger of renewed liquification of the binders occurring thus reducing the possible final strength of the core to approx. 80 to 85%.

Later, a further process became known in which dispenser pumps are to be used between the catalyst source and the mixing station for carrier gas and catalyst, in order to be able to dispense the catalyst better. However, here too, this can only bring about an unsatisfactory result because the pressure conditions in the first runnings of the catalyst are at first absolutely indifferent with each dispensing action.

Subsequently, somewhat better results were achieved in that both the catalyst vapor-carrier gas mixture and the compressed air are each stored temporarily in a dispensing container, and from these dispensing containers they are then shot into a core, in sudden consecutive blasts, whereby the compressed air is stored with a larger volume and heated to a higher temperature than is the case with the catalyst vapor-carrier gas mixture.

However, technical expenditure for these measures is enormous and plants of this kind allow few variables.

It has therefore been proposed that for the production of the catalyst vapor-carrier gas mixture the catalyst be added in liquid form to a jet ahead of the heating stage, whereby its exit jet, influenced by an additional atomizing gas streaming through the jet, disintegrates.

However, such equipment allows only gasification with very inaccurate dispensing.

It is thus the object of the present invention to create a device of the type mentioned above which allows the most optimal dispensing of the required catalyst with the shortest gasification time, and at the same time the use of the most varied processes with the most varied parameters, such as subsequent pressure stages or proportional pressure increase, different quantities of catalyst gas and time discretion for the charging of carrier gas or compressed air.

SUMMARY OF THE INVENTION

According to the invention this is at first attained in that the valve means in the first runnings pipe of the receiver tank can temporarily be changed over to a return pipe to the receiver tank, to bring about pressure equalisation in the first runnings system.

First of all this measure assures highly accurate dispensing because the pressure conditions in the catalyst first runnings can now be kept absolutely constant with each dispensing action, after the pressure equalization is carried out beforehand in each instance.

In accordance with present technology, the respective change-over of the valve means, as well as the remaining switching and control elements of the device, are program-controllable.

It has been found that while pressure equalization in the catalyst first runnings prior to each dispensing action does allow considerably more accurate dispensing of the catalyst, this is nevertheless considered as still offering scope for improvement, in particular in respect to lowering the quantity of catalyst needed for each reaction.

This is now achieved, according to the invention, in that the mixing stage comprises a block-shaped evaporator part made of porous ceramic.

It has been found that porous ceramic has a very large interior surface which is completely wetted by the catalyst streaming in, whereby the carrier gas streaming in, as a rule air, is exposed to the most intensive contact with the wetted surface and thus causes optimal discharge of the catalyst into the core, allowing a respective reduction in the quantity of the catalyst.

Additionally it is very important that in line with the large-scale airflow through the ceramic evaporator the transport of the catalyst into the core happens gradually, so that remaining amines are still reaching the core when it has already hardened, thus considerably improving its surface hardness.

Such a ceramic evaporator can comprise silicon carbide, aluminium oxide, zircon oxide or zircon carbide, and can be active-chromium nickel plated.

Its flow-through can occur in pressure stages or with proportional pressure increase.

Furthermore, it has been found that with such a ceramic-body in a magnetic field, the catalyst can be additionally activated and its mass can be further reduced. As a result, according to the invention, a permanent magnet is provided at the block-shaped ceramic part. In this the ceramic body can be enriched with iron oxide.

BRIEF DESCRIPTION OF THE DRAWINGS

An embodiment of the object according to the invention is described in more detail below, by means of the drawing, which in block diagrams, depicts the device for hardening foundry cores.

DESCRIPTION OF THE PREFERRED EMBODIMENTS

The equipment shown for hardening foundry cores from a mass containing sand, which can be connected to a core form-tool 10 of a core shooter (not shown in detail) first comprises a mixing stage 1, i.e., mixing means 1,—that can be placed ahead of the form-tool 10 to generate a catalyst vapor carrier gas mixture—which is in a flow connection with a catalyst receiver tank 5 as well as with a program-controlled compressed-air source 6, by way of program-controlled valve means 2, pump means 3 and flow meter 4. These construction units, as well as further units such as a flow heater 11 and a temperature probe 12, which can be connected after the mixing stage, are program-controllable by way of a control stage 13, i.e., control means 13.

According to the invention, the valve means 2 in the first runnings pipe 7 of the receiver tank 5 can be temporarily changed over to a return pipe 8 to the receiver tank 5, to bring about pressure equalization in the first runnings system, as described in detail above.

Furthermore, according to the invention, the mixing stage 1 comprises a block-shaped evaporator part 9 made of porous ceramic; this evaporator can comprise silicon carbide, aluminium oxide, zircon oxide or zircon carbide, and can be active-chromium nickel plated.

Furthermore, at the ceramic body 9, a permanent magnet 14 can be active.

Following the pressure equalization mentioned, the dispensing valve 2, depending on the signal of the flow meter 4 or in a time-dependent way, is changed over by way of the control stage 13, whereby the catalyst reaches the mixing stage. Concurrently or subsequently, the transport air is added and then the mixture, if applicable by way of a flow heater 11, is conducted to the core. Afterwards, scavenging air can be supplied if required.

First of all this measure assures highly accurate dispensing because the pressure conditions in the catalyst first runnings pipe 7 can now be kept absolutely constant with each dispensing action, after prior pressure equalization in each instance. Furthermore, the porous ceramic evaporator allows optimal discharge of the catalyst into the core and accordingly a substantial reduction in catalyst quantity as stated above. Furthermore, in line with the large-scale airflow through the ceramic evaporator, the transport of the catalyst into the core happens gradually, so that remaining amines are still reaching the core when it has already hardened. This considerably improves surface hardness of the core.

What is claimed is:

1. A device for hardening a core mass containing sand contained within a foundry core forming tool, comprising:

mixing means in communication with the foundry core forming tool for introducing a flow of a carrier gas stream enriched by catalyst vapor into the core mass containing sand;

a first runnings system including a catalyst receiver tank containing catalyst, a first runnings pipe in communication with the catalyst receiver tank and the mixing means, a pump provided in the first runnings pipe for pumping catalyst from the catalyst receiver tank through the first runnings pipe, valve means provided in the first runnings pipe for dispensing catalyst into the mixing means, and a flow meter provided in the first running pipe between the pump and the valve means;

a compressed air source in communication with the mixing means for providing a carrier gas stream comprised of air thereto; and programmed control means for controlling the valve means of the first runnings system and the compressed air source;

wherein the valve means provided in the first runnings pipe may be temporarily utilized as a return pipe to the receiver tank by means of the programmed control means so that pressure equalization in the first runnings system is obtained.

2. The device according to claim 1, wherein the core mass containing sand which is exposed to the carrier gas stream enriched by catalyst vapor is subsequently exposed to a compressed air stream.

3. The device according to claim 1, wherein the mixing means is comprised of an evaporator which has a block shape and which is comprised of porous ceramic.

4. The device according to claim 3, wherein the evaporator is plated with active-chromium nickel.

5. The device according to claim 3, wherein the porous ceramic of the evaporator is enriched with iron oxide.

6. The device according to claim 5, wherein the mixing means further comprises a permanent magnet positioned at the evaporator so that the permanent magnet is active with respect to the evaporator enriched with iron oxide.

7. The device according to claim 3, wherein the porous ceramic is comprised of a ceramic material selected from the group consisting of silicon carbide, aluminum oxide, zirconium oxide, and zirconium carbide.

8. The device according to claim 3, wherein the flow of a carrier gas stream enriched by catalyst vapor through the evaporator takes place in use in one of pressure stages or with proportional pressure increase.

9. A process of hardening a foundry core within a core forming tool of a core shooter, comprising:

providing the core forming tool with a device according to claim 1 hardening the foundry core within the core forming tool of the core shooter.

* * * * *

UNITED STATES PATENT AND TRADEMARK OFFICE

CERTIFICATE OF CORRECTION

PATENT NO : 5,971,056

DATED : October 26, 1999

INVENTOR(S): Wilhelm Bovens

It is certified that error appears in the above-identified patent and that said Letters Patent are hereby corrected as shown below:

On the title page, item [73], Assignee; the assignee's name should read: --LÜBER GmbH--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*